US005181630A

United States Patent [19]

McNally

[11] Patent Number: 5,181,630

[45] Date of Patent: Jan. 26, 1993

[54] VESSEL HAVING DUAL FUNCTION POURING SPOUT FOR SPOT TREATING OR RAPID TRANSFER OF VISCOUS LIQUIDS

[75] Inventor: Mark P. McNally, Cincinnati, Ohio

[73] Assignee: The Procter & Gamble Company, Cincinnati, Ohio

[21] Appl. No.: 717,455

[22] Filed: Jun. 19, 1991

[51] Int. Cl.[5] ..... B67D 1/16

[52] U.S. Cl. ..... 222/109; 222/571; 222/572; 222/575

[58] Field of Search ..... 222/109, 111, 551, 562, 222/571, 572, 575; 220/288; 215/329

[56] References Cited

U.S. PATENT DOCUMENTS

| | | | |
|---|---|---|---|
| 1,156,784 | 10/1915 | King . | |
| 1,357,629 | 11/1920 | Faistl et al. | 222/571 X |
| 1,648.068 | 11/1927 | Shockley . | |
| 1,918,117 | 7/1933 | Martin . | |
| 1,925,913 | 9/1933 | Wood | 65/31 |
| 2,039,345 | 5/1936 | Revenscroft | 215/31 |
| 2,535,871 | 12/1950 | Seigh | 222/542 |
| 2,587,344 | 2/1952 | Livingstone | 222/571 |
| 2,601,039 | 6/1952 | Livingstone | 222/109 |
| 2,657,838 | 11/1953 | Kramer et al. | 222/569 |
| 2,741,902 | 4/1956 | Thompson | 65/31 |
| 2,793,790 | 5/1957 | Kahler | 222/109 |
| 2,804,103 | 8/1957 | Wall | 141/381 |
| 3,102,667 | 9/1963 | Ullevig | 222/569 |
| 3,309,000 | 3/1967 | Haverstick | 222/569 |
| 3,434,637 | 3/1969 | Marcel | 222/570 |
| 3,549,062 | 12/1970 | Teetor | 222/571 |
| 3,700,146 | 10/1972 | Cousins et al. | 222/572 X |
| 3,833,150 | 9/1974 | Visser-Patings | 222/109 |
| 3,860,148 | 1/1975 | Sherin | 222/153 |
| 3,895,743 | 7/1975 | Christian | 222/143 |
| 3,961,732 | 6/1976 | Roberts | 272/570 |
| 4,078,700 | 3/1978 | Hidding | 222/109 |
| 4,298,145 | 11/1981 | Iida | 222/478 |
| 4,349,056 | 9/1982 | Heino | 141/381 |
| 4,494,682 | 1/1985 | Beckstrom et al. | 222/551 |
| 4,550,862 | 11/1985 | Barker et al. | 222/109 |
| 4,566,508 | 1/1986 | Bowyer | 141/381 |
| 4,566,509 | 1/1986 | Szajna | 141/381 |
| 4,591,078 | 5/1986 | Weissman | 222/517 |
| 4,630,761 | 12/1986 | Thomson | 222/572 X |
| 4,696,416 | 9/1987 | Muckenfuhs et al. | 222/109 |
| 4,706,829 | 11/1987 | Li | 215/354 |
| 4,741,459 | 5/1988 | Silvenis et al. | 222/23 |
| 4,802,597 | 2/1989 | Dubach | 215/307 |
| 4,850,501 | 7/1989 | Shield | 220/90.4 |
| 4,863,067 | 9/1989 | Krall | 222/111 |
| 4,890,770 | 1/1990 | Haga et al. | 222/109 |
| 4,917,268 | 4/1990 | Campbell et al. | 222/109 |
| 4,917,269 | 4/1990 | Fuchs et al. | 222/109 |
| 4,974,749 | 12/1990 | Mon | 222/111 |
| 4,981,239 | 1/1991 | Cappel et al. | 222/109 |
| 4,989,757 | 2/1991 | Krall | 222/111 |
| 4,993,605 | 2/1991 | Del'Re | 222/545 |

*Primary Examiner*—Gregory L. Huson

*Attorney, Agent, or Firm*—E. Kelly Linman; Thomas H. O'Flaherty

[57] ABSTRACT

A liquid dispensing vessel having a pour spout which will provide substantially mess-free dispensing of viscous liquids, such as laundry detergents, during two different modes of dispensing: a concentrated stream as might be used for spot treating articles of clothing; and a bulk dispensing cycle to quickly empty the vessel's contents into a washing machine. The dual function pouring spout of the present invention may be employed either directly on a bulk liquid container or on a closure member used to transfer liquid from a bulk liquid container to a washing machine.

22 Claims, 13 Drawing Sheets

VESSEL HAVING DUAL FUNCTION POURING SPOUT FOR SPOT TREATING OR RAPID TRANSFER OF VISCOUS LIQUIDS

TECHNICAL FIELD

The present invention relates to a liquid dispensing vessel having a pour spout.

The present invention has further relation to such a liquid dispensing vessel having a pour spout which will provide substantially mess-free dispensing of viscous liquids, such as laundry detergents, during two different modes of dispensing: a concentrated stream as might be used for spot treating articles of clothing; and a bulk dispensing cycle to quickly empty the vessel's contents into a washing machine.

BACKGROUND ART

Liquid dispensing vessels having pour spouts intended to provide mess-free dispensing of viscous liquids, such as laundry detergents, are well known in the art. These have typically been embodied on closures which are used to transfer liquid from a bulk liquid container to a washing machine. They have also been embodied directly on bulk liquid containers.

In general, these prior art structures facilitate a single mode of dispensing in the form of a product stream of substantially constant cross-section. While these prior art solutions function reasonably well for rapid transfer of large quantities of liquid into an appliance, such as a washing machine, laundry detergent formulations are frequently used as a pretreating agent and applied directly onto discrete portions of an article of clothing before the clothing is deposited into the washing machine. Bulk liquid dispensing structures of the prior art intended to provide rapid substantially mess-free transfer of large quantities of liquid do not readily lend themselves toward such spot treating applications.

OBJECTS OF THE INVENTION

Accordingly, it is an object of the present invention to provide a vessel which facilitates not only rapid substantially mess-free dispensing of large quantities of liquid, but which is also capable of providing substantially mess-free dispensing of a relatively small concentrated stream of liquid for spot treating of discrete articles of clothing prior to dispensing the unused contents of the vessel into a laundry appliance, such as a washing machine.

It is another object of the present invention to provide such dual mode dispensing capability on closures which are utilized to reseal a bulk liquid container which houses the liquid to be dispensed.

It is still another object of the present invention to provide a bulk liquid container having a pouring spout capable of providing such dual mode substantially mess-free dispensing.

DISCLOSURE OF THE INVENTION

The dual function pouring spout on a vessel of the present invention allows for cleaner overall usage and controlled pouring of liquids under two different circumstances, as compared to a prior art vessel without any pouring spout or as compared to a prior art vessel having a pouring spout, but without the dual function pouring capability of a vessel of the present invention.

The dual function pouring spout of the present invention comprises a first outwardly directed pouring spout portion having two dams, one on either side, to control the flow of liquid during both modes of dispensing. When the vessel is first tilted to begin pouring, the dams restrict flow so that product flows only through the directed pouring spout portion. In a laundry detergent application this allows the control of liquid necessary for pretreating clothing with a small, controlled stream of highly viscous liquid.

Whenever a vessel of the present invention is tilted for dispensing, any liquid that flows past the tip of the outwardly directed pour spout portion during dispensing will clear the rim, the thread and any collar or shoulder on the vessel to which the spout is attached. This is due to the outwardly projecting position of the tip of the directed portion of the dual function pouring spout on vessels of the present invention. Accordingly, the rim and the exterior surfaces of the vessel remain substantially free from contamination by the liquid being dispensed during the vessel's first mode of operation, i.e., during slow, controlled dispensing.

Once pretreating is complete, the vessel can, if desired, be emptied completely through the directed pouring spout portion of the dual function pouring spout in the same way pretreating is carried out, although the flow will be slower than need be. Alternatively, it may be desirable to further tilt the axis of the vessel toward or even past horizontal and pour the liquid remaining in the vessel after pretreating quickly out of the vessel over the dams, e.g., as by pouring the whole vessel of liquid into the washing machine.

In a particularly preferred embodiment of the present invention a substantially vertically projecting lip is provided along the innermost edge of each of the dams so that the liquid poured from the vessel during its second mode of operation, i.e., during rapid dispensing will pour over the dams and be directed outwardly away from the rim and the exterior surfaces of the vessel. This substantially prevents contamination of the rim and the exterior surfaces of the vessel by the liquid being dispensed during the rapid transfer mode of pouring.

If desired, the uppermost surface of each dam may also be provided with a sharp edged pour lip at its outermost edge located nearest the rim of the vessel. This sharp edged pour lip may, if desired, extend outwardly as far as the root diameter of the external thread on the vessel to which the spout is attached without causing interference with the complementary thread on another vessel to which the spouted vessel is to be releasably secured or vice versa. The further the sharp edged pour lip extends over the rim of the vessel, the greater will be the clearance between the rim, the external thread and the exterior surfaces of the vessel and any liquid stream which is allowed to flow across the uppermost surfaces of the dams and be discharged from the sharp edged pour lip during rapid dispensing.

In a particularly preferred embodiment of the present invention the dual function pouring spout further includes a drainback channel or a reservoir located between the interior rim of the vessel and the dual function pouring spout. In the case of a drainback channel, any liquid drops that may form on the lowermost surfaces of the pour spout portion or the dams after a pouring cycle are collected and returned to the vessel when the vessel is restored to its upright position. In the case of a reservoir, any drips that may form on the lowermost surfaces of the pour spout and the dams are also collected when the vessel is restored to its upright position. However, unlike the drainback channel, the reservoir has a finite capacity for liquid and it is not emptied until such time as the vessel itself is stored in an inverted position, e.g., as when a closure of the present invention is reapplied to a bulk liquid container.

Thus, vessels employing dual function pouring spouts of the present invention provide two modes of substantially mess-free dispensing using the same spout: either a small controlled stream through the directed pouring spout portion; or rapid pouring through the directed pouring spout portion and over the dams adjacent the directed pouring spout portion. In a laundry detergent application, this becomes highly useful since the small stream facilitates substantially mess-free pretreating, while rapid pouring facilitates quick, yet substantially mess-free delivery of the liquid to the washing machine.

BRIEF DESCRIPTION OF THE DRAWINGS

While the specification concludes with claims that particularly point out and distinctly claim the subject matter regarded as forming the present invention, it is believed that the invention will be better understood from the following detailed description with reference to the drawings in which:

DETAILED DESCRIPTION OF THE INVENTION

Figure 1:
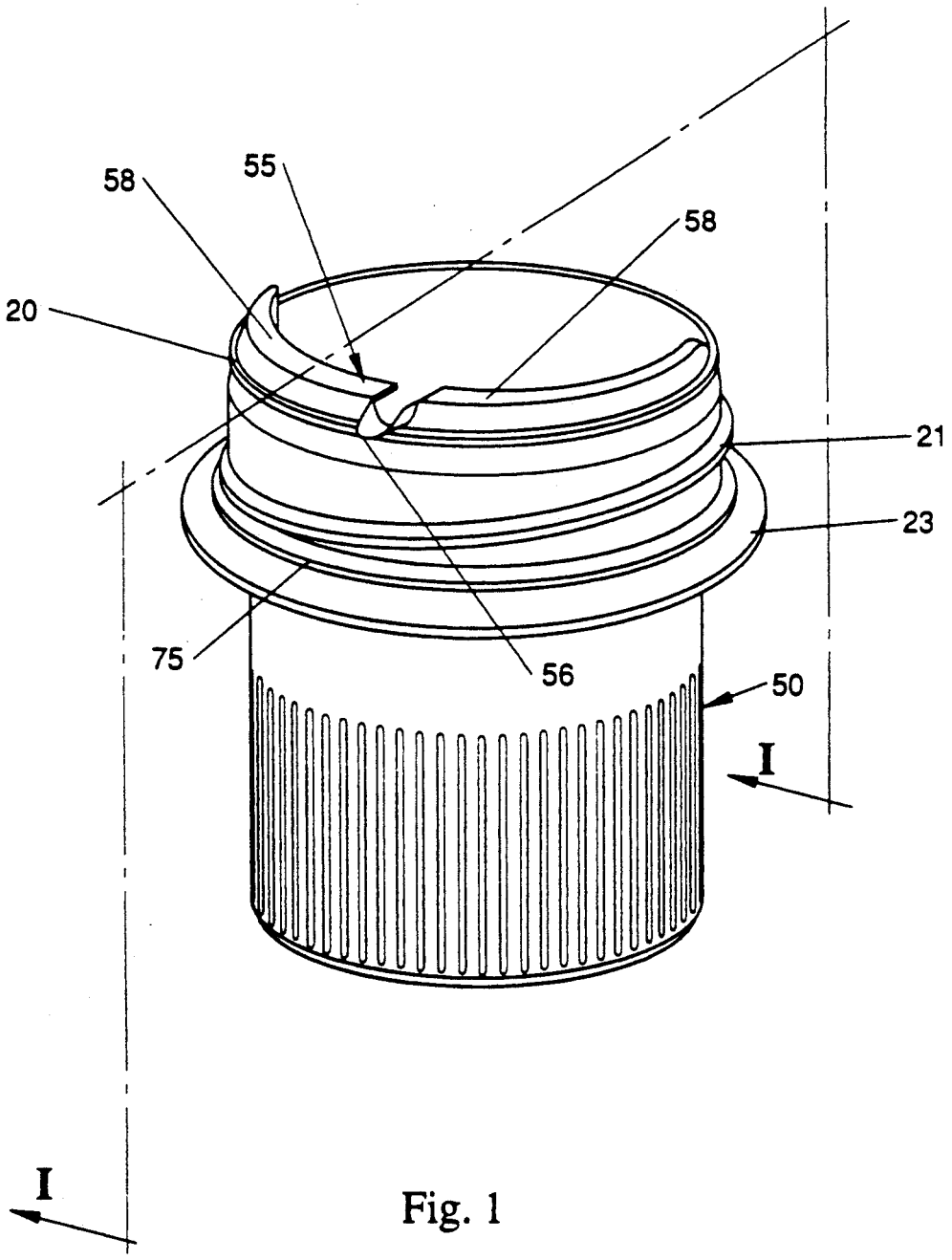
FIG. 1 is a simplified perspective illustration of a first embodiment of the present invention.

FIG. 1 is a simplified perspective view of an externally threaded vessel 50 including a dual purpose pouring spout 55 of the present invention.

Figure 1A:
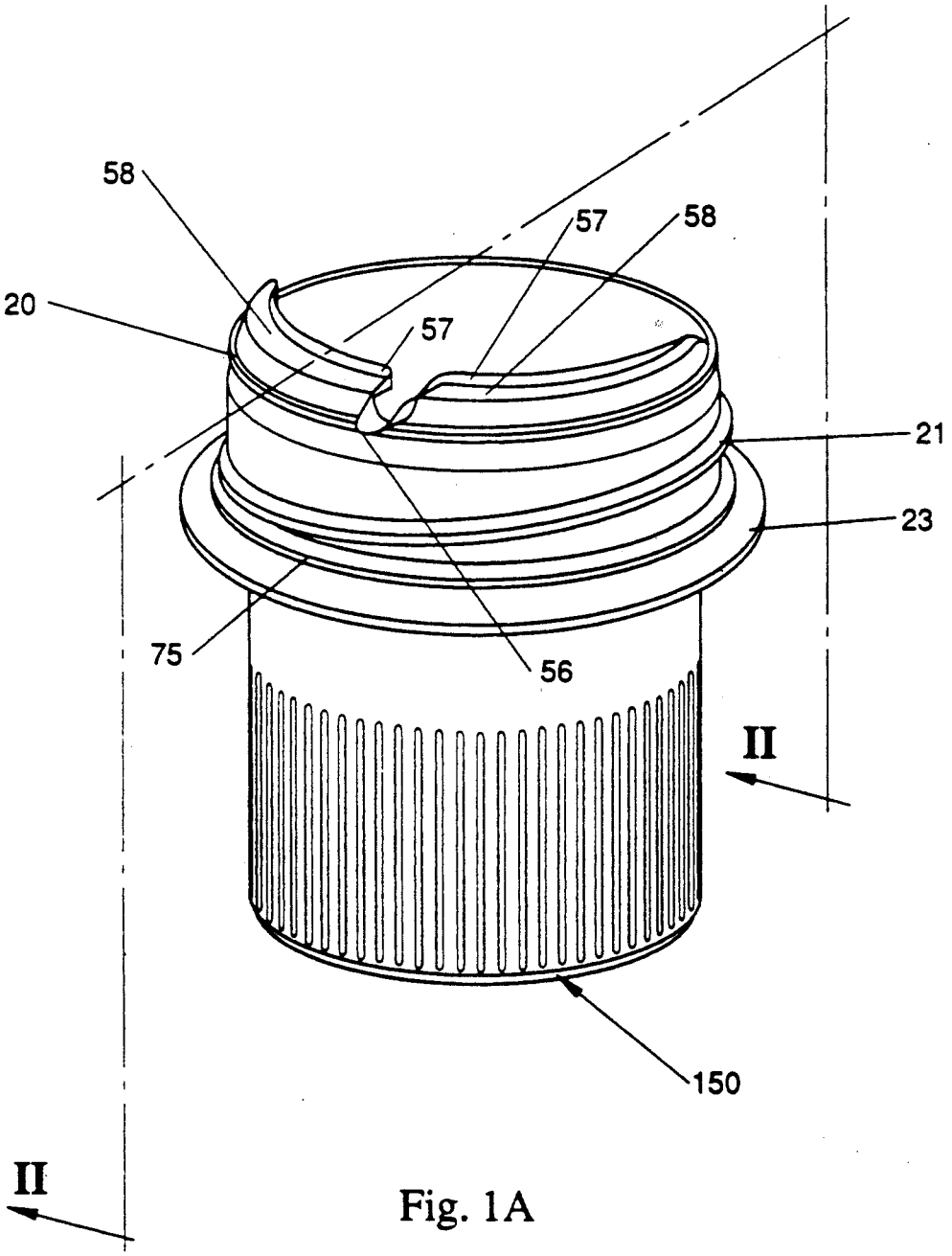
FIG. 1A is a simplified perspective illustration of a second embodiment of the present invention.
Figure 1B:
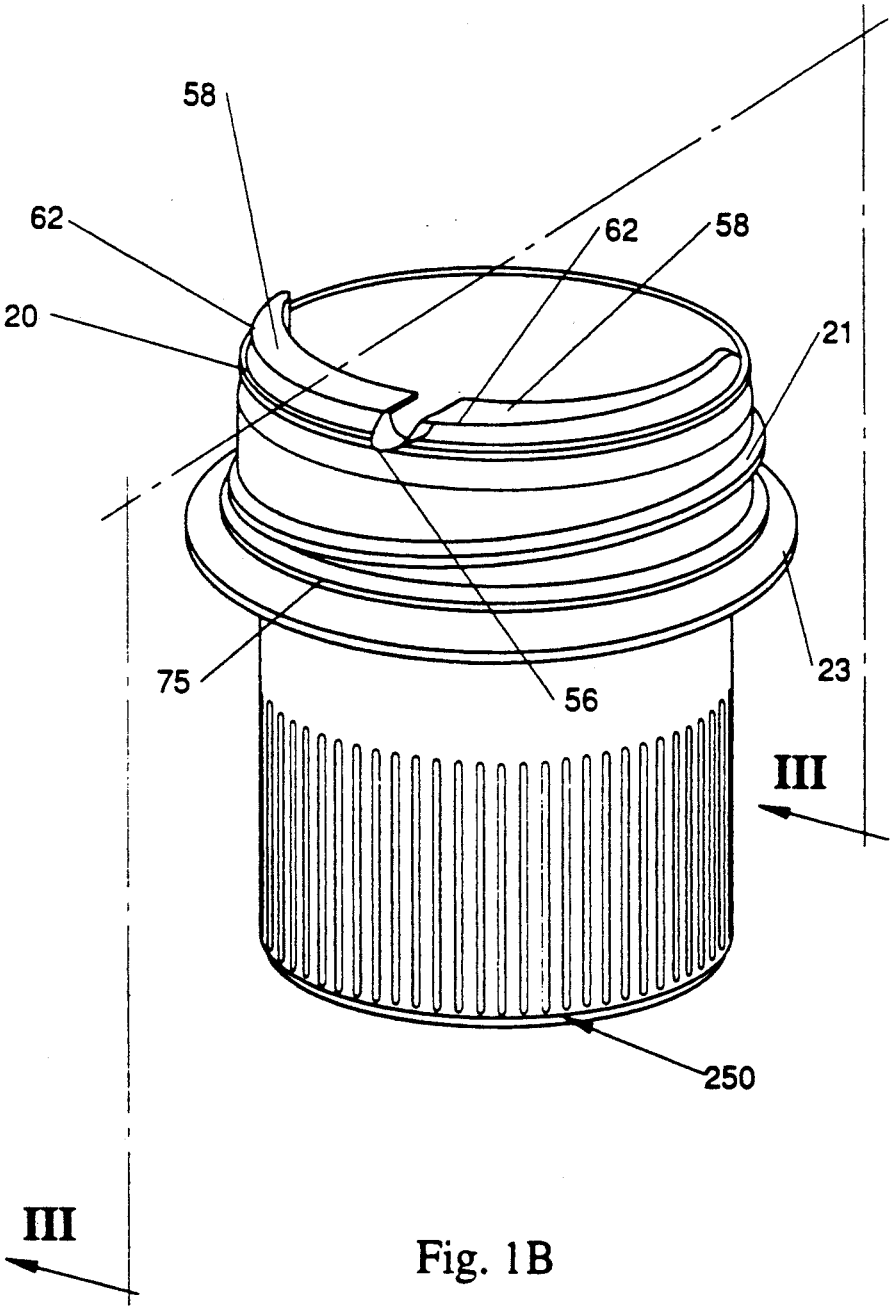
FIG. 1B is a simplified perspective illustration of a third embodiment of the present invention.
Figure 1C:
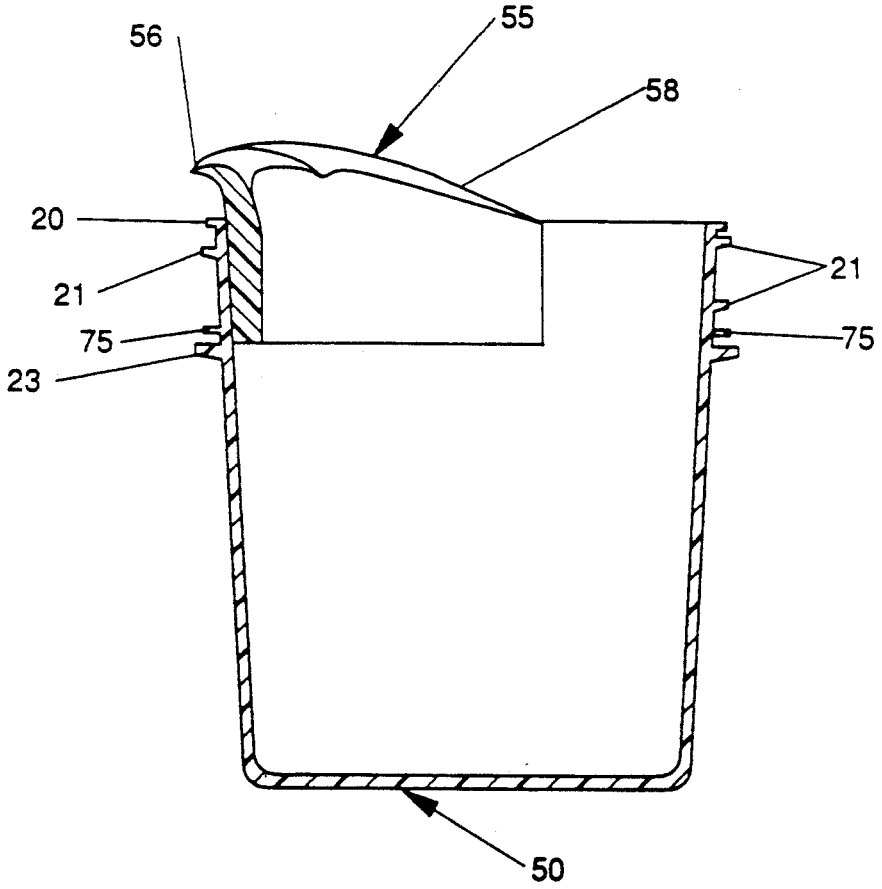
FIG. 1C is a cross-sectional view of the preferred embodiment generally illustrated in FIG. 1, said view being taken at a point corresponding to section line I—I in FIG. 1.

FIG. 1C is a simplified vertical cross-sectional view of the externally threaded vessel 50 shown in FIG. 1, said view being taken through the center of the dual purpose pouring spout 55 along section line I—I in FIG. 1. The vessel 50, which may comprise a closure for a bulk liquid container, is typically constructed of a moldable polymeric material, such as polypropylene. The dual purpose pouring spout 55 will be of the same material as the vessel 50 if the vessel and the spout are injection molded as one piece. In this case, it will normally be necessary to either employ flexible dams 58 to allow the spout 55 to be pulled off of the mold without damaging its shape, or to employ a mold having a collapsible or a separable insert so that it can be easily removed from the interior of the closure without damaging the dams. For example, the mold insert that forms the spout and the interior of the closure 50 could be comprised of two or more segments which are removed sequentially to permit clearing the dams 58 during the removal process.

Conversely, the spout 55 could be molded as a separate piece and later inserted into and secured to the vessel 50, as by an adhesive or a heat seal. In the latter case the spout 55 could be of a different moldable polymeric material than the closure. Alternatively, the spout could be molded as a ring insert (not shown) and press-fit inside the rim of the closure 50. The particular method of fabrication is non-critical.

As can be seen from FIGS. 1 and 1C, the directed pouring spout portion 56 of the dual purpose pouring spout 55 is positioned up and out over the rim 20 of the vessel 50 so that the liquid being dispensed will not come into contact with the rim 20, the external helical thread 21, the flexible sealing ring 75, the shoulder 23 or the exterior surfaces of the closure 50 during any angle of pouring. Maximum outward positioning of the directed pouring spout portion 56 can be achieved without causing difficulty in releasably securing the primary vessel 50 to a secondary vessel having a complementary helical thread by keeping the cross-sectional profile of the tip 56 of the spout 55 within the cross-sectional confines of a hypothetical extension of the helical external thread 21, as generally taught in my concurrently filed, commonly assigned U.S. patent application entitled OUTWARDLY PROJECTING DIRECTED POUR SPOUT EXHIBITING THREAD COMPATIBLE CROSS-SECTIONAL PROFILE, Ser. No. 07/717,754, the disclosure of which is hereby incorporated herein by reference.

FIG. 1A is a simplified perspective view of another externally threaded vessel 150 of the present invention, said vessel being generally similar to the vessel 50 of FIG. 1, but including an additional feature. Specifically, vessel 150 further includes a pair of substantially vertically extending lips 57 located at the innermost edges of dams 58 o help to ensure that the liquid will not come in contact with the rim 20, the external thread 21, the flexible sealing ring 75, the shoulder 23 or the exterior surfaces of vessel 150 when liquid is rapidly dispensed from vessel 150 over both the directed pouring spout portion 56 and the dams 58.

Figure 1D:
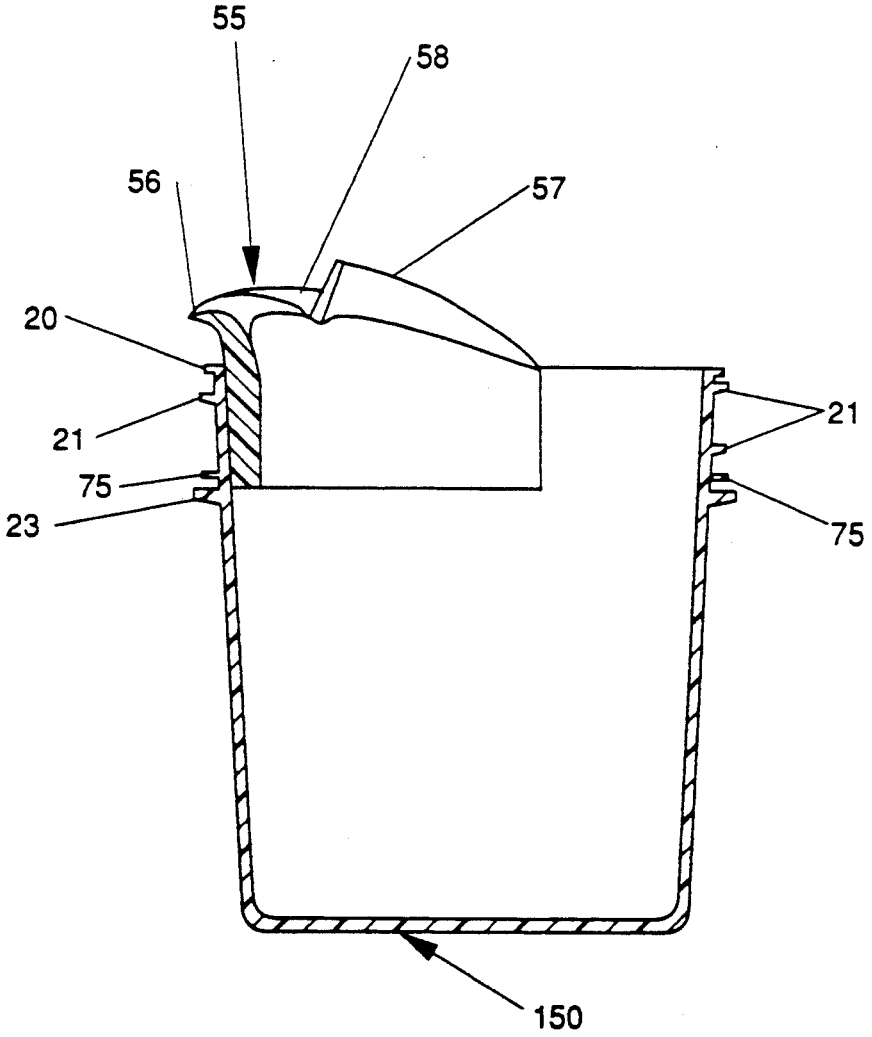
FIG. 1D is a simplified cross-sectional view of the embodiment shown in FIG. 1A, said view being taken at a point corresponding to section line II—II in FIG. 1A.
Figure 4:
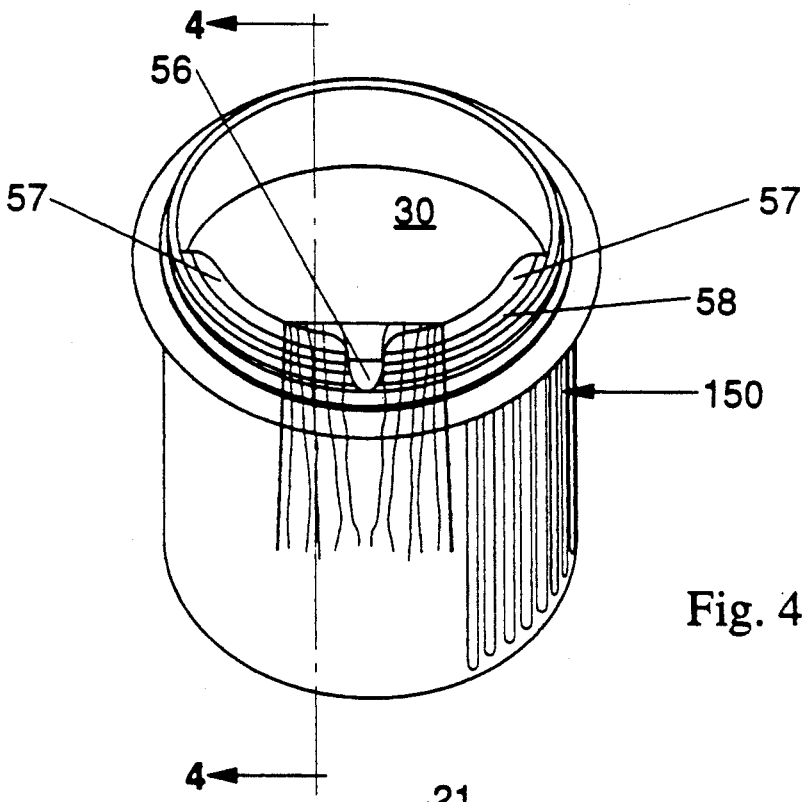
FIG. 4 is a simplified perspective view of the vessel of FIG. 1 during a rapid liquid transfer cycle.
Figure 5:
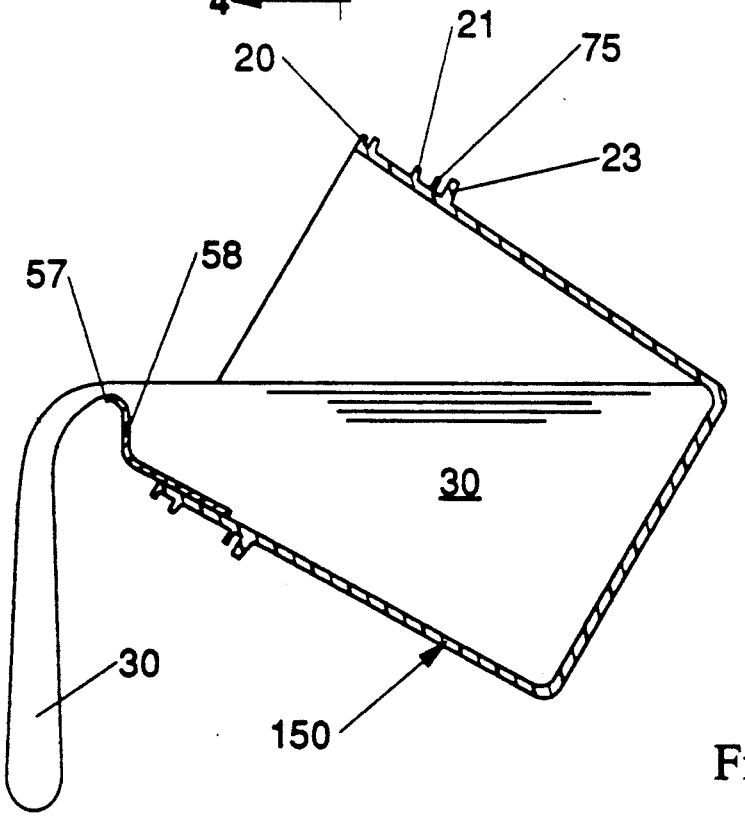
FIG. 5 is a cross-sectional view of the vessel shown in FIG. 4 taken along section line IV—IV in FIG. 4.

A simplified cross-sectional view of vessel 150 taken along section line II—II of FIG. 1A is shown in FIG. 1D. The function of each substantially vertically extending lip 57 in maximizing the clearance between the stream of liquid and the exterior surfaces of vessel 150 during rapid pouring of liquid is illustrated in perspective and in cross-section in FIGS. 4 and 5, respectively.

FIG. 1B is a simplified perspective view of another externally threaded vessel 250 of the present invention, said vessel being generally similar to the vessel 50 of FIG. 1, but including a sharp edged pour lip 62 located at the outermost edge, as measured radially from the center of the vessel, of each of the liquid restraining dams 58. The sharp edged pour lip 62 is more clearly illustrated in the cross-section of FIG. 1E, which is taken at a point substantially corresponding to section line III—III in FIG. 1B.

The sharp edged pour lip 62 is preferably positioned as far outwardly as feasible to maximize the clearance between any liquid stream which is permitted to flow across the uppermost surfaces of dams 58 prior to being discharged off the sharp edged pour lip. This is best shown in the simplified cross-section of FIG. 1F, which is a simplified cross-sectional view taken through one of the dams 58 during a rapid pouring cycle, said view being taken at a point corresponding to section line III—III in FIG. 1B. The maximum diameter of the sharp edged pour lip 62 is, in general, limited by the root diameter of the external helical thread 21 on vessel 250, i.e., pour lip 62 must not interfere with the threading action between the primary vessel 250 and a secondary vessel (not shown) having a complementary helical thread.

Each sharp edged pour lip 62, which preferably extends substantially across the outermost edge of each dam 58, may be employed with or without a substantially vertically extending lip 57 of the type generally shown in FIGS. 1A and 1D.

Figure 1E:
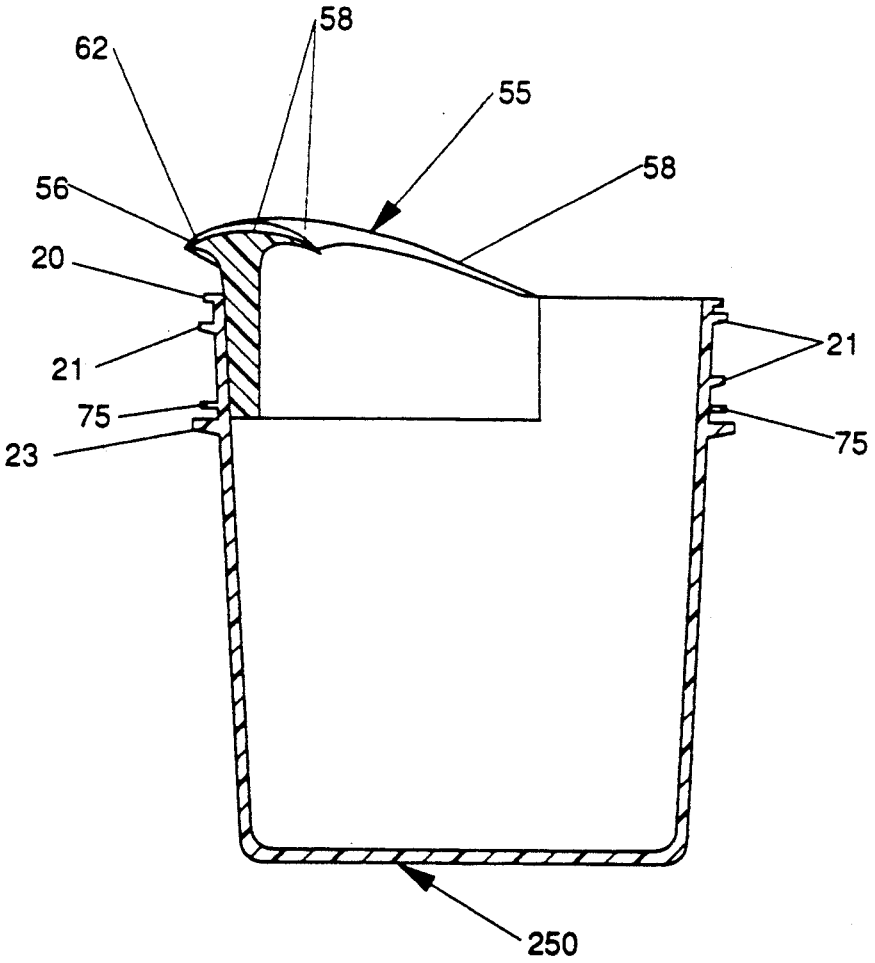
FIG. 1E is a simplified cross-sectional view of the embodiment shown in FIG. 1B, said view being taken at a point corresponding to section line III—III in FIG. 1B.
Figure 1F:
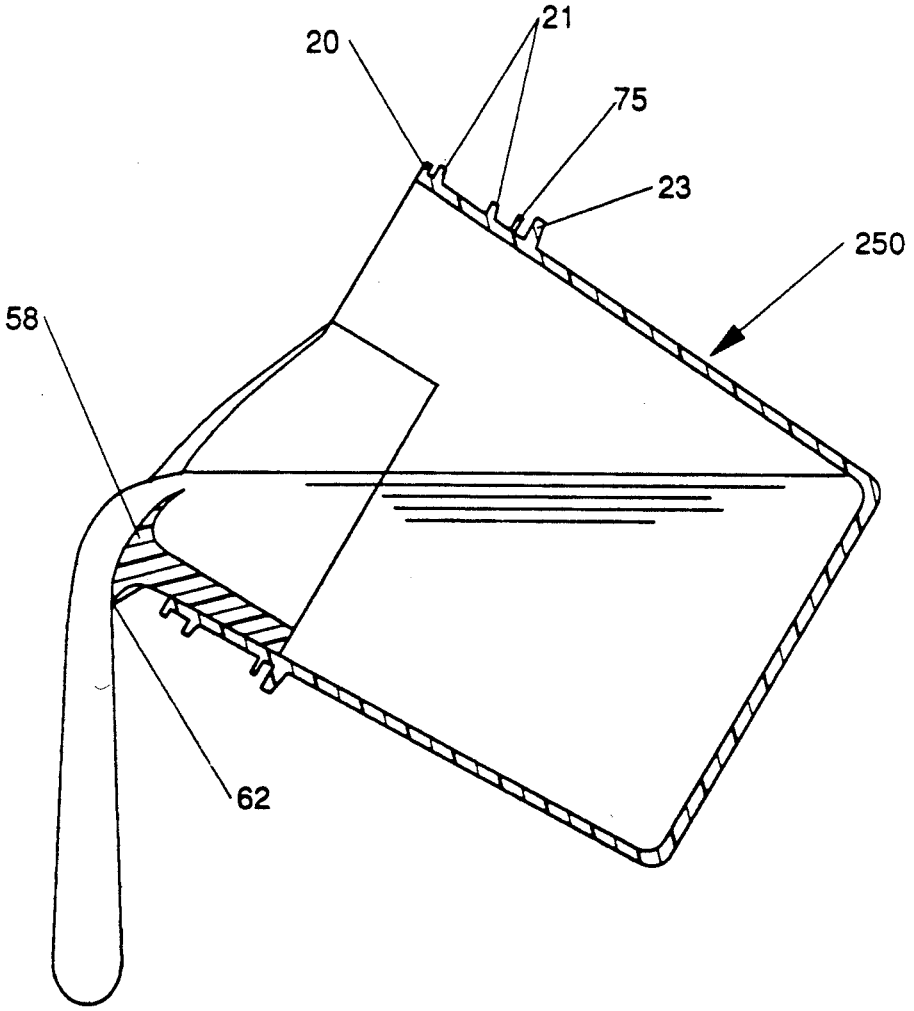
FIG. 1F is a simplified cross-sectional view of the vessel shown in FIGS. 1B and 1E during a rapid liquid pouring cycle, said view being taken at a point corresponding to section line III—III in FIG. 1B.

The sharp edged pour lips 62 provide a sharp cut-off of liquid flow when the vessel 250 is returned to a substantially vertical position, as generally shown in FIG. 1E. Any liquid remaining on the uppermost surfaces of dams 58 after a pouring cycle has been completed drains back into the vessel 250 after the dispensing cycle has been completed due to the generally downward orientation of the innermost edges of the dams 58. In the event a substantially vertical lip 57 is employed on each of the dams 58 in conjunction with a sharp edged pour lip 62, drain back into the vessel occurs by virtue of the liquid flowing along the uppermost surfaces of dams 58 at their points of intersection with vertically extending lips 57 until the vertically extending lips 57 substantially blend with the uppermost surfaces of dams 58, as generally shown in the perspective view of FIG. 1A.

Figure 2:
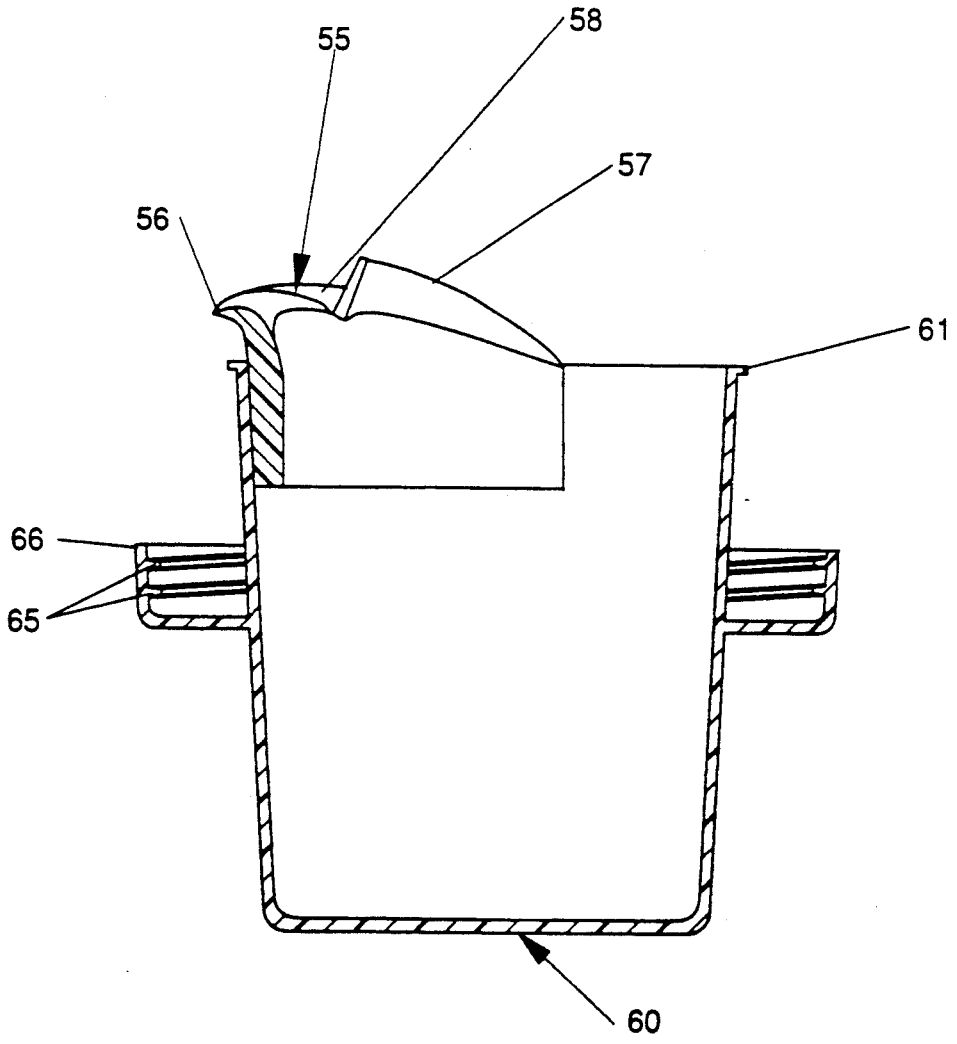
FIG. 2 is a cross-sectional view of an alternative embodiment of a vessel having a dual function pouring spout of the present invention.

FIG. 2, which is a simplified cross-sectional view generally similar to that of FIG. 1D, illustrates how a dual purpose pouring spout 55 of the present invention may be employed on an internally threaded vessel, such as closure 60. Manufacturing techniques and material considerations for producing closure 60 are essentially the same as those for producing closure 150 shown in FIG. 1A.

Like the embodiment of FIG. 1A, the tip of the directed pouring spout portion 56 of the dual purpose pour spout 55 used on internally threaded closure 60 is positioned up and out over the rim 61 of closure 60 so that liquid being dispensed will not come into contact with the internal helical thread 65 or the collar 66 during any angle of pouring. As with closure embodiment 150 of FIG. 1A, the substantially vertically extending lips 57 on dams 58 help to ensure that liquid 30 will not come into contact with the rim 61, the internal thread 65, the collar 66 or the exterior surfaces of vessel 60 when liquid is rapidly dispensed out of closure 60, as generally illustrated with respect to vessel embodiment 150 in FIGS. 4 and 5.

Figure 3:
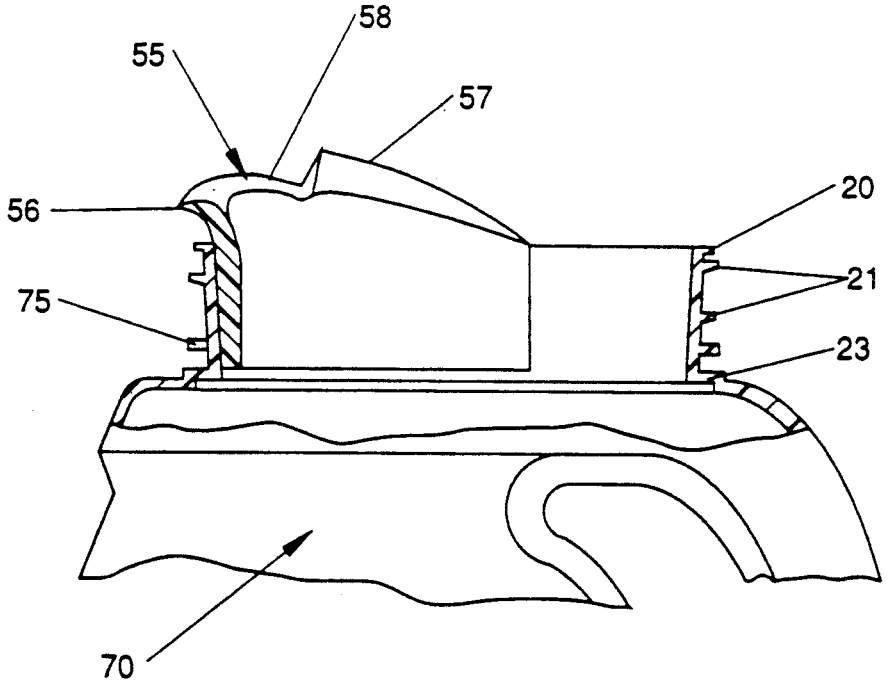
FIG. 3 is a partial cross-sectional view of a bulk liquid container having a dual function pouring spout of the present invention.

FIG. 3 illustrates how a dual purpose pouring spout 55 of the present invention may be employed directly on an externally threaded bulk liquid container 70. Manufacturing conditions and modes of pouring for bulk liquid container 70 are generally similar to those associated with closure embodiment 150 shown in FIGS. 1A and 1D.

Figure 6:
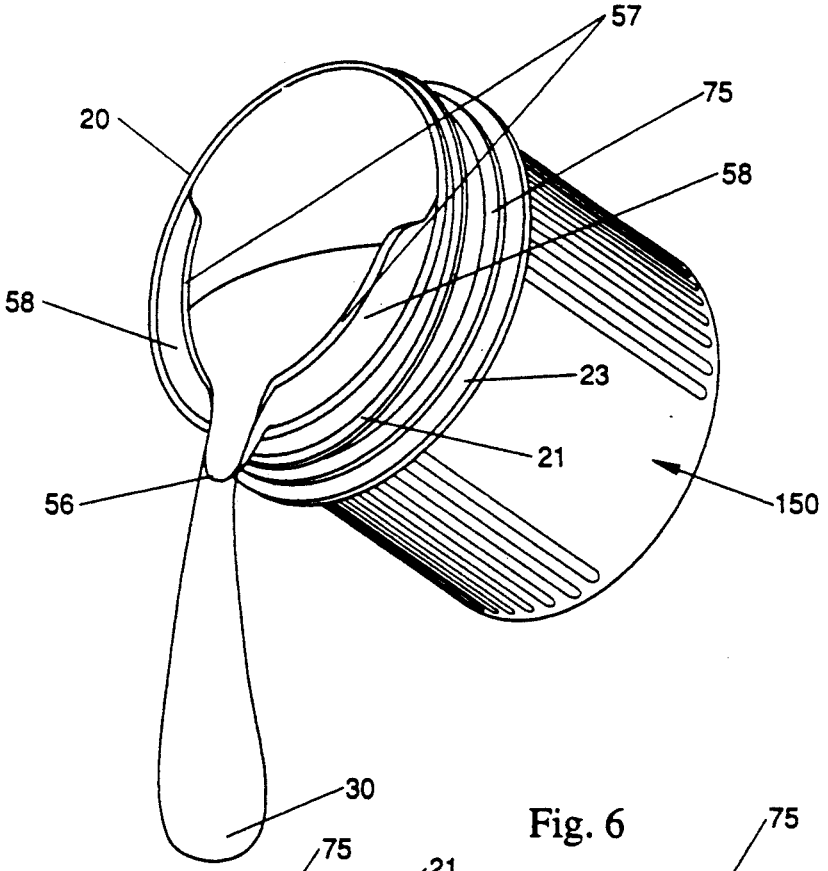
FIG. 6 is a simplified perspective view of the vessel of FIG. 1A as it would be used for spot treating articles of clothing prior to inserting them into a washing machine.
Figure 7:
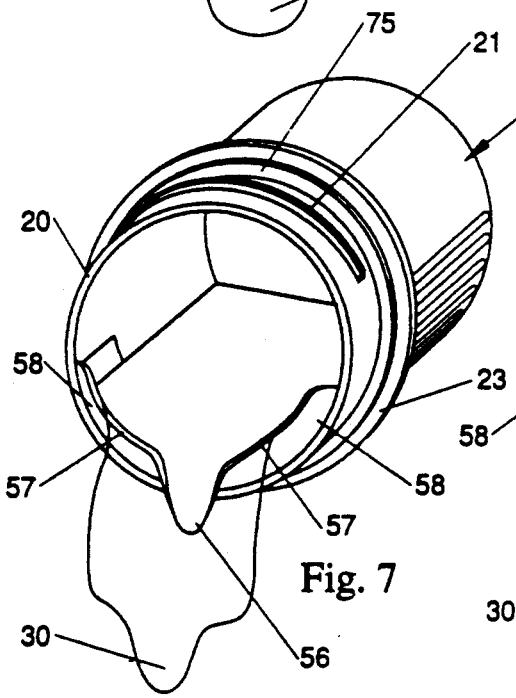
FIG. 7 is a perspective view of the vessel of FIGS. 1A and 6 as it would be used during the rapid liquid transfer portion of the dispensing cycle.

Accompanying Drawing FIGS. 6 and 7 illustrate the two different modes of pouring using a single vessel of the present invention. In particular, FIG. 6 shows the condition of a vessel 150 of the type generally shown in FIGS. 1A and 1D, said vessel having a dual purpose pour spout 55. In FIG. 6 the vessel 150 is shown as it first begins to pour. The dams 58 restrict the flow of liquid 30 so that liquid flows only through the directed pouring spout portion 56 of dual purpose pour spout 55. In a laundry detergent application, for example, this would allow the user to control the flow of liquid, as desired, for pretreating clothing with a controlled stream of highly viscous liquid. If the user so desires, the vessel 150 could thereafter be completely emptied through the directed pouring spout portion 56 of the dual function pouring spout 55, as generally shown in FIG. 6. However, the flow of liquid will be much slower than need be if this procedure is followed.

In the case of a liquid laundry detergent, it is normally desirable to pour the remaining liquid 30 quickly out of the vessel 150 over the dams 58 and the upwardly extending lips 57 once pretreating has been completed. FIG. 7 shows how the substantially vertically extending lips 57 on dams 58 of the dual purpose pouring spout 55 force the stream of liquid 30 further away from the rim 20, the external helical thread 21, the flexible sealing ring 75, the shoulder 23 and the exterior surfaces of vessel 150 when pouring occurs at the more rapid rate, i.e., during the vessel's second mode of operation.

Figure 7A:
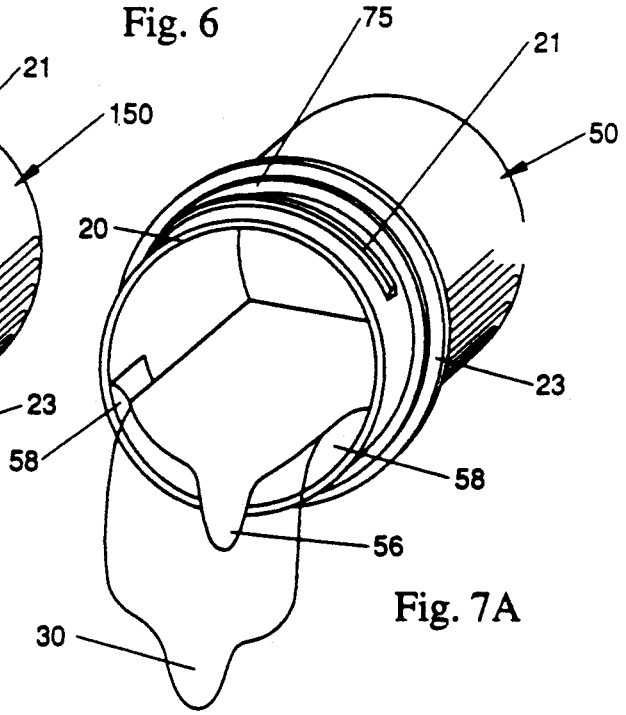
FIG. 7A is a perspective view of the vessel of FIGS. 1 and 1C as it would be used during the rapid liquid transfer portion of the dispensing cycle.

FIG. 7A is a view of a vessel 50 of the type generally shown in FIGS. 1 and 1C during a pouring operation comparable to that shown in FIG. 7. During the first mode or slow pouring phase of the dispensing operation, vessel 50 will behave in the same manner as vessel 150, as generally shown in FIG. 6. However, because vessel 50 does not employ the substantially vertically extending lips 57 on dams 58, the stream of liquid 30 tends to sheet across the uppermost surfaces of the dams 58 during the rapid transfer portion of the dispensing cycle is discharged from the outermost or front edges of the dams. Liquid remaining on the uppermost surfaces of dams 58 after a dispensing cycle of the type illustrated in FIG. 7A returns to the bottom of the vessel 50 at the conclusion of each dispensing cycle due to the generally downward slope of the innermost edges of dams 58, as shown in FIG. 1C.

Figure 8:
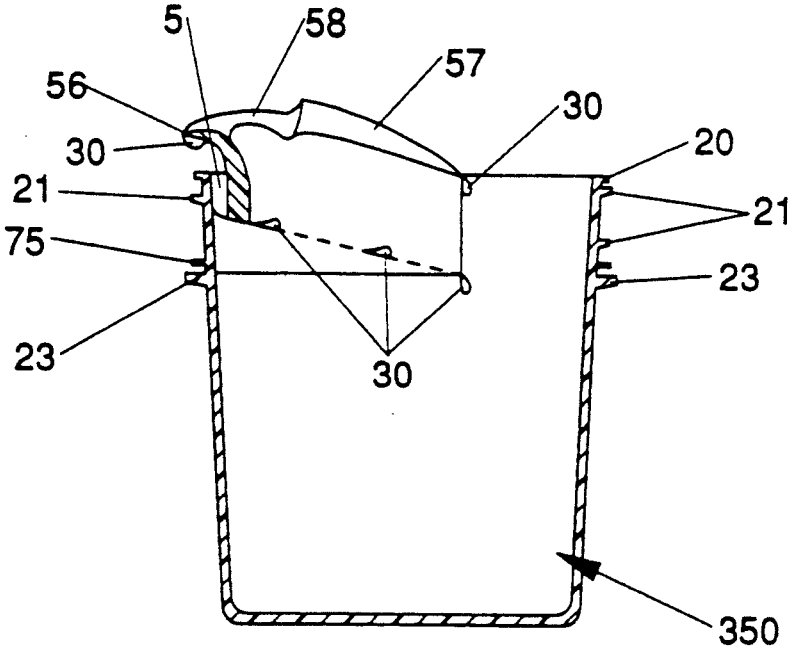
FIG. 8 is a simplified cross-sectional view of another vessel of the present invention incorporating both a dual function pouring spout and a drainback channel.

FIG. 8 is a cross-sectional view of another externally threaded vessel 350 of the present invention taken through the center of the directed pouring spout portion 56 of the dual-function pouring spout 55. The vessel 350 differs from vessel 150 of FIGS. 1A and 1D in that it further includes a drainback channel 5 located between the innermost surface of vessel 350 and the outermost surface of dual function pouring spout 55. Like the embodiment of FIGS. 1A and 1D, the tip of the directed portion 56 of the dual function pour spout 55 is positioned up and out over the rim 20 of vessel 350 so that the liquid being dispensed will not come in contact with the rim 20, the external thread 21, the flexible sealing ring 75, the shoulder 23 or the exterior surfaces of the vessel during any angle of pouring. If any liquid 30 remains on the directed portion 56 of the dual function pour spout 55 after the vessel 350 is returned from a liquid dispensing position to its upright position, the surface tension of the liquid 30, combined with the slight upward angle of the bottom of the tip of the spout, allows the drips of liquid to follow along the bottom of the spout 55 and ultimately into the drainback channel 5. Due to the downward slope of the outermost ends of drainback channel 5, any liquid 30 which enters the drainback channel ultimately flows back to the bottom of the vessel 350, assuming the vessel is left in the position shown in FIG. 8 for a sufficient period of time. If, on the other hand, the vessel 350 is returned to the top of a bulk liquid container immediately after a liquid dispensing cycle, as would normally be the case when the vessel 350 comprises a closure, the angle of the uppermost surface of the dams 58 will cause any liquid 30 remaining thereon to flow back into the bulk container (not shown) in the manner generally illustrated in FIG. 9.

Figure 9:
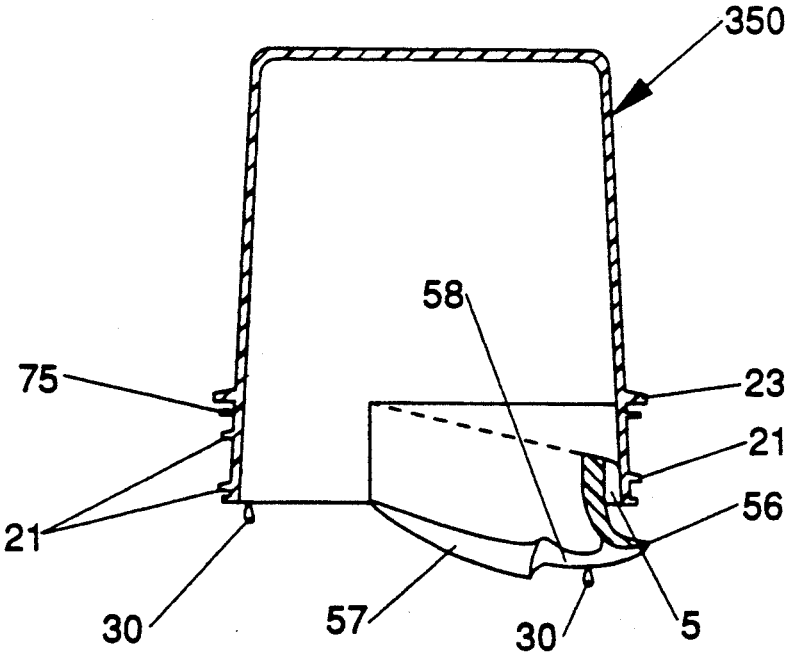
FIG. 9 is a view of the vessel shown in FIG. 8 after it has been inverted for reapplication to a bulk liquid container.

The drainback channel 5 illustrated in FIGS. 8 and 9 may, of course, be incorporated with equal facility on internally threaded closures of the type generally shown in FIG. 2 or on bulk liquid containers of the type generally shown in FIG. 3.

Figure 10:
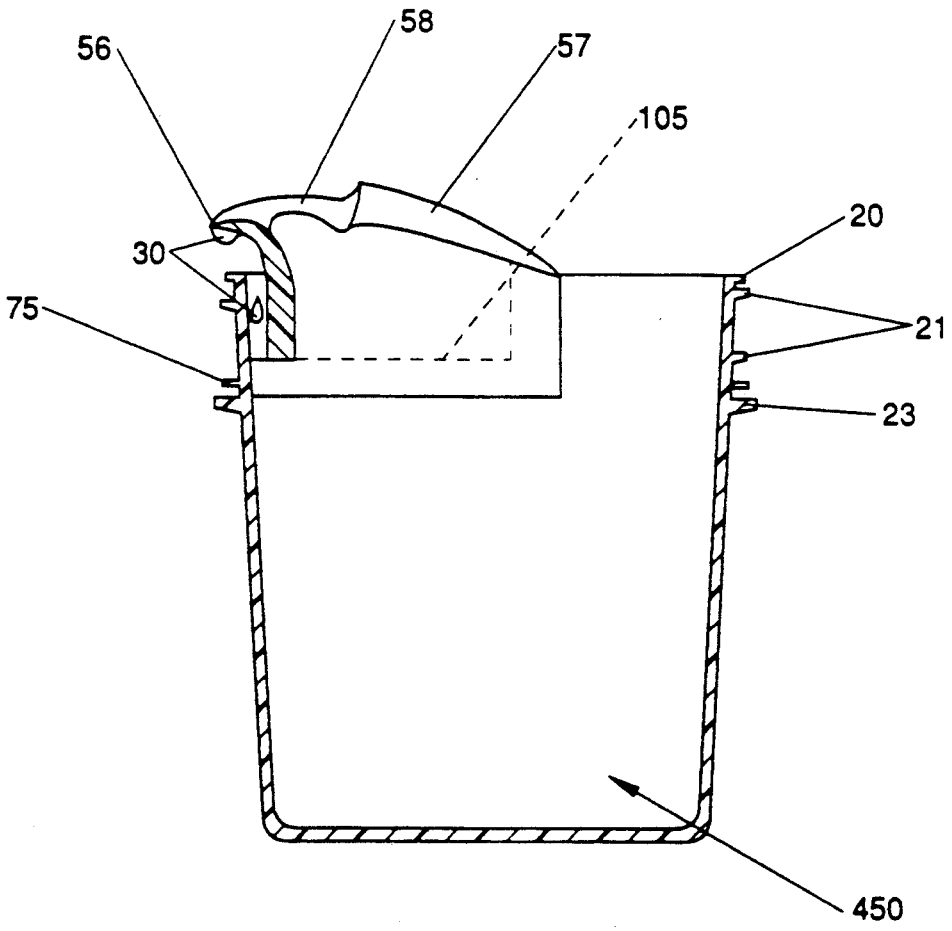
FIG. 10 is a simplified cross-sectional view of still another vessel of the present invention incorporating a dual function pouring spout and a drainback reservoir.

Alternatively, the drainback channel 5 may be replaced by a simple reservoir 105, as generally shown on closure vessel 450 in FIG. 10. The reservoir 105 accumulates any drops of liquid 30 which form on the outermost surface of the dual function pouring spout 55, but does not return them to the bottom of the closure vessel 450 or the bulk liquid container until the closure vessel 450 is inverted and reapplied to the bulk liquid container (not shown). Accordingly, the reservoir's capacity must be sufficient to keep the accumulated liquid 30 within its confines until such time as the closure vessel 450 is reapplied to the bulk liquid container.

While the present invention has been described in the context of vessels used to handle viscous liquids, such as laundry detergents, vessels of the present invention may be used with equal facility to dispense a wide range of liquids, e.g., fabric softeners, cooking oils, automotive fluids and the like. In addition, it will be obvious to those skilled in the art that various changes and modifications can be made to vessels of the present invention without departing from the spirit and scope of the present invention, and it is intended to cover in the appended claims all such modifications that are within the scope of this invention.

What is claimed is:

1. In a vessel for dispensing liquid, the improvement wherein said vessel includes an outwardly directed pouring spout portion for dispensing small quantities of said liquid from said vessel in a concentrated stream without contaminating the exterior surfaces of said vessel, said pouring spout portion including a pair of opposed edges, said vessel further including a pair of opposed dams extending from said opposed edges of said outwardly directed pouring spout portion to initially prevent the escape of liquid from within said vessel, each of said dams having an upper most surface defined by an innermost edge and an outermost edge, said innermost edges of said dams being at a lower elevation that said outermost edges of said dams so that any liquid remaining on said uppermost surfaces of said dams is caused in drain back into said vessel when said vessel is returned to an upright position, whereby small quantities of said liquid can be slowly dispensed through only said first outwardly directed pouring spout portion and large quantities of said liquid can be rapidly dispensed by further tilting said vessel so that said liquid will be dispensed not only through said directed pouring spout portion, but also over said dams without contaminating the exterior surfaces of said vessel.

2. In a vessel for dispensing liquid, the improvement wherein said vessel includes an outwardly directed pouring spout portion for dispensing small quantities of said liquid from said vessel in a concentrated stream without contaminating the exterior surfaces of said vessel, said pouring spout portion including a pair of opposed edges, said vessel further including a pair of opposed dams extending from said opposed edges of said outwardly directed pouring spout portion to initially prevent the escape of liquid from within said vessel, each of said dams further including a substantially vertically extending lip along its innermost edge, whereby large quantities of liquid can be rapidly dispensed from said vessel over said outwardly directed pouring spout portion and said substantially vertically extending lips on said dams without contaminating the exterior surfaces of said vessel.

3. The structure of claim 1, wherein the uppermost surface of each of said dams further includes a sharp edged pour lip at its outermost edge, whereby a large quantity of liquid can be rapidly dispensed by passing it across the uppermost surfaces of said dams and discharging it form said sharp edged pour lip.

4. The structure of claim 1, claim 2 or claim 3, wherein said vessel comprises a bulk liquid container, said bulk liquid container further including a closure member releasably secured thereto.

5. The structure of claim 1, claim 2 or claim 3, wherein said vessel comprises a closure member which is to be releasably secured to a bulk liquid container.

6. The structure of claim 1, claim 2 or claim 3, said structure further including a drainback channel positioned between the interior surface of said vessel and the outermost surfaces of said outwardly directed pouring spout portion and said dams, whereby any drops of liquid which cling to the outermost surfaces of said outwardly directed pouring spout portion and said dams after pouring are caused to collect in said drainback channel from whence they reenter said vessel.

7. The structure of claim 6, wherein the opposed ends of said drainback channel are at a lower elevation within said vessel than the portion of said drainback channel substantially coinciding with said outwardly directed pouring spout portion.

8. The structure of claim 1, claim 2 or claim 3, said structure further including a drainback reservoir positioned between the interior surface of said vessel and the outermost surfaces of said outwardly directed pouring spout portion and said dams, whereby any drops of liquid which cling to the outermost surfaces of said outwardly directed pouring spout portion and said dams after pouring are caused to collect in said drainback reservoir.

9. The structure of claim 1, claim 2 or claim 3, wherein the outermost ends of said dams are at a lower elevation than the portions of said dams adjacent said outwardly directed pouring spout portion when said vessel is in an upright position.

10. The structure of claim 9, wherein the outermost ends of said opposed dams extend to a point slightly less than the midpoint of said vessel.

11. The structure of claim 5, wherein said vessel comprises an externally threaded closure for handling laundry fluids and wherein said first outwardly directed pouring spout portion is used primarily for pretreating discrete portions of items to be laundered and said substantially vertically extending lips on said dams are used to rapidly transfer said laundry fluids from an internally threaded bulk container housing said laundry fluids to a laundry appliance.

12. The structure of claim 1, claim 2 or claim 3, wherein said dams are integrally molded with said vessel and are comprised of a resiliently deformable polymeric material to facilitate removal of said vessel from the mold in which said vessel is formed without permanent damage to said dams.

13. The structure of claim 12, wherein said polymeric material comprises polyethylene.

14. In a vessel for dispensing liquid, the improvement wherein said vessel includes an outwardly directed pouring spout portion for dispensing small quantities of said liquid from said vessel in a concentrated stream without contaminating the exterior surfaces of said vessel, said pouring spout portion including a pair of opposed edges, further including a pair of opposed dams extending from said opposed edges of said first outwardly directed pouring spout portion to initially prevent the escape of liquid from within said vessel when small quantities of said liquid are being dispensed through said first outwardly directed pouring spout portion, each of said dams further including a substantially vertically extending lip along its innermost edge, said lip exhibiting its maximum vertical extension in the area adjacent said directed pouring spout portion and tapering to a lesser vertical extension adjacent the outermost end of each of said dams, whereby large quantities of liquid can be rapidly dispensed from said vessel over said outwardly directed pouring spout portion and said substantially vertically extending lips on said dams without contaminating the exterior surfaces of said vessel.

15. The structure of claim 14, wherein said vessel comprises a closure member which is to be releasably secured to a bulk liquid container.

16. The structure of claim 15, further including a drainback channel positioned between the interior surface of said vessel and the outermost surfaces of said outwardly directed pouring spout portion and said dams, whereby any drops of liquid which cling to the outermost surfaces of said outwardly directed pouring spout portion and said dams after pouring are caused to collect in said drainback channel from whence they reenter said vessel.

17. The structure of claim 16, wherein the opposed ends of said drainback channel are at a lower elevation within said vessel than the portion of said drainback channel substantially coinciding with said outwardly directed pouring spout portion.

18. The structure of claim 15, further including a drainback reservoir positioned between the interior surface of said vessel and the outermost surfaces of said outwardly directed pouring spout portion and said dams, whereby any drops of liquid which cling to the outermost surfaces of said outwardly directed pouring spout portion and said dams after pouring are caused to collect in said drainback reservoir.

19. The structure of claim 14, wherein the outermost ends of said opposed dams are at a lower elevation than the portions of said dams adjacent said outwardly directed pouring spout portion when said vessel is in an upright position.

20. The structure of claim 19, wherein the outermost ends of said opposed dams extend to a point slightly less than the midpoint of said vessel.

21. The structure of claim 20, wherein said dams are integrally molded with said vessel and are comprised of a resiliently deformable polymeric material to facilitate removal of said vessel from the mold in which said vessel is formed without permanent damage to said dams.

22. The structure of claim 21, wherein said polymeric material comprises polyethylene.

* * * * *

UNITED STATES PATENT AND TRADEMARK OFFICE

CERTIFICATE OF CORRECTION

PATENT NO. : 5,181,630

DATED : January 26, 1993

INVENTOR(S) : Mark P. McNally

It is certified that error appears in the above-identified patent and that said Letters Patent is hereby corrected as shown below:

Column 4, line 68, "o" should read -- to -- .

Column 8, line 44, "form" should read -- from -- .

Column 9, line 38, before "further" insert -- said vessel--

Signed and Sealed this

Fourteenth Day of December, 1993

*Attest:*

*Attesting Officer*

BRUCE LEHMAN

*Commissioner of Patents and Trademarks*